US012667877B2

(12) United States Patent
Baba et al.

(10) Patent No.: US 12,667,877 B2
(45) Date of Patent: Jun. 30, 2026

(54) METHOD FOR DETECTING ABNORMAL VIBRATION OF ROLLING MILL, APPARATUS FOR DETECTING ABNORMALITY OF ROLLING MILL, ROLLING METHOD, AND METHOD FOR PRODUCING METAL STRIP

(71) Applicant: JFE STEEL CORPORATION, Tokyo (JP)

(72) Inventors: Wataru Baba, Tokyo (JP); Masahide Yajima, Tokyo (JP); Takehide Hirata, Tokyo (JP); Yukio Takashima, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 360 days.

(21) Appl. No.: 18/283,994

(22) PCT Filed: Feb. 4, 2022

(86) PCT No.: PCT/JP2022/004544
§ 371 (c)(1),
(2) Date: Sep. 25, 2023

(87) PCT Pub. No.: WO2022/209294
PCT Pub. Date: Oct. 6, 2022

(65) Prior Publication Data

US 2024/0033799 A1 Feb. 1, 2024

(30) Foreign Application Priority Data

Mar. 31, 2021 (JP) ..... 2021-060119

(51) Int. Cl.
*B21B 38/00* (2006.01)
*B21C 51/00* (2006.01)

(52) U.S. Cl.
CPC ..... *B21B 38/008* (2013.01); *B21C 51/00* (2013.01)

(58) Field of Classification Search
CPC ..... B21B 38/008; B21B 38/00; B21C 51/00; G01H 1/06; G01H 17/00; G01M 99/00
See application file for complete search history.

(56) References Cited

U.S. PATENT DOCUMENTS

2006/0117834 A1* 6/2006 Goto ..... G01L 23/225 73/35.09
2008/0297367 A1* 12/2008 Chen ..... G08B 13/1409 340/687

FOREIGN PATENT DOCUMENTS

AU 2015201595 A1 10/2016
CN 1319035 A 10/2001
(Continued)

OTHER PUBLICATIONS

Apr. 5, 2022 International Search Report issued in International Patent Application No. PCT/JP2022/004544.
(Continued)

*Primary Examiner* — Redhwan K Mawari
(74) *Attorney, Agent, or Firm* — Oliff PLC

(57) ABSTRACT

A method for detecting abnormal vibration of a rolling mill including a collecting step of collecting vibration data of the rolling mill, a frequency analysis step of generating first analysis data indicative of vibration intensities at respective frequencies by performing frequency analysis of the vibration data, a data conversion step of converting the first analysis data into second analysis data indicative of vibration intensities at respective intervals on the basis of a rolling speed, and a map generation step of generating a vibration map in which a plurality of the second analysis data are arranged in time series.

14 Claims, 6 Drawing Sheets

(56) References Cited

FOREIGN PATENT DOCUMENTS

| | | | | | |
|---|---|---|---|---|---|
| CN | 102179413 | A | | 9/2011 | |
| CN | 103934286 | A | | 7/2014 | |
| CN | 111922095 | A | | 11/2020 | |
| EP | 1125649 | A1 | | 8/2001 | |
| JP | S62-9709 | A | | 1/1987 | |
| JP | H08-108205 | A | | 4/1996 | |
| JP | 4018932 | B2 | * | 12/2007 | |
| JP | 2010180836 | A | * | 8/2010 | |
| JP | 2013-010110 | A | | 1/2013 | |
| JP | 2013-111614 | A | | 6/2013 | |
| JP | 2016-2582 | A | | 1/2016 | |
| JP | 2016516590 | A | * | 6/2016 | ..... B21B 45/0218 |
| JP | 2016-153138 | A | | 8/2016 | |
| JP | 2019-122979 | A | * | 7/2019 | ..... B21B 38/00 |
| JP | 2020-104133 | A | | 7/2020 | |
| KR | 2010-0108033 | A | | 10/2010 | |
| KR | 20110046649 | A | | 5/2011 | |
| KR | 10-2011-0070537 | A | | 6/2011 | |
| KR | 20130062186 | A | * | 6/2013 | ..... C23C 2/40 |
| KR | 20180074188 | A | * | 7/2018 | ..... G06Q 50/10 |
| TW | 462900 | B | | 11/2001 | |

OTHER PUBLICATIONS

May 31, 2024 Office Action issued in European Application No. 22779523.4.

Jun. 7, 2022 Office Action issued in Japanese Patent Application No. 2022-523333.

Sep. 6, 2025 Office Action issued in Chinese Patent Application No. 202280022601.5 (with concise explanation of relevance in English).

Nov. 19, 2025 Office Action issued in U.S. Appl. No. 18/283,958.

* cited by examiner

METHOD FOR DETECTING ABNORMAL VIBRATION OF ROLLING MILL, APPARATUS FOR DETECTING ABNORMALITY OF ROLLING MILL, ROLLING METHOD, AND METHOD FOR PRODUCING METAL STRIP

TECHNICAL FIELD

This application relates to a method for detecting vibration occurring in a rolling mill that rolls a steel sheet into a predetermined thickness. More specifically, the application relates to a method for detecting abnormal vibration of a rolling mill that causes a defect on a surface of a steel sheet, an apparatus for detecting an abnormality, a rolling method, and a method for producing a metal strip.

BACKGROUND

In general, a steel sheet used for an automobile, a beverage can, or the like is subjected to continuous casting, hot rolling, and cold rolling, undergoes an annealing process and a plating process, and is then processed according to an intended purpose. The cold rolling process is a final process that determines a steel sheet thickness of a product. Since a surface of a steel sheet before plating determines a surface of a final product after the plating, it is required to prevent a surface defect in the cold rolling process.

One example of the surface defect occurring in the cold rolling process is chatter marks. The chatter marks are a pattern in which a linear mark extending in a width direction of a metal strip periodically appears in a longitudinal direction of the metal strip, and is considered to occur mainly because of vibration (chattering) of a rolling mill. Very slight chatter marks are not found by visual check, sheet thickness measurement, and the like performed after rolling and are found for the first time after a plating process. This constitutes a factor that markedly deteriorates productivity. Furthermore, especially in a case of a thin material such as a steel sheet for can or an electrical steel sheet, it is known that a rapid fluctuation in sheet thickness or tension caused by chattering causes a phenomenon such as breakage of a sheet and inhibits production.

Conventionally, various chattering detection methods and chattering prevention methods have been developed from a perspective of preventing inhibition of productivity and a surface defect (see, for example, Patent Literatures 1 to 3) Patent Literature 1 discloses that a vibration detector is attached to a rolling mill and vibration obtained by the vibration detector and rolling parameters are subjected to frequency analysis. Patent Literature 1 describes a chattering detection method in which fundamental frequencies that can occur for respective causes of vibration are concurrently calculated and it is determined that chattering has occurred in a case where vibration energy at a frequency that is an integral multiple of the fundamental frequency obtained as a result of the frequency analysis exceeds a setting value.

Patent Literatures 2 and 3 describe a detection method in which a vibration detector is disposed not only on a rolling mill body, but also on rolls (small-diameter rolls) that are disposed between stands and on entry and exit sides of a cold rolling mill and around which a metal sheet is wound to a certain angle or more, frequency analysis is performed on obtained vibration values, and it is determined that chattering has occurred in a case where a frequency that matches a frequency of string vibration of a steel sheet exceeds a threshold value and a chattering prevention method in which a frequency of string vibration is controlled so as not to match a fundamental frequency of a rolling mill by controlling tension.

CITATION LIST

Patent Literature

PTL 1: Japanese Unexamined Patent Application Publication No. 08-108205

PTL 2: Japanese Unexamined Patent Application Publication No. 2016-153138

PTL 3: Japanese Unexamined Patent Application Publication No. 2016-2582

SUMMARY

Technical Problem

However, in the case of Patent Literature 1, noise generated from equipment around a rolling mill and vibration generated from a vibration source disposed in a rolling mill body are also detected, and therefore erroneous detection often occurs. In the case of Patent Literatures 2 and 3, occurrence of vibration caused by string vibration can be suppressed, but it is difficult to detect vibration generated from other vibration sources. Furthermore, it is difficult to identify a frequency at which chattering occurs in advance, and it is often not until vibration in a certain frequency band becomes large that the frequency of chattering can be recognized. It is therefore difficult to detect chattering with high accuracy even if attention is focused on a specific frequency in advance and a threshold value corresponding to an amplitude or the like corresponding to the specific frequency is set. Especially in a continuous cold rolling mill (tandem rolling mill), a metal strip line speed (rolling speed) varies from one stand to another. Accordingly, a rotation speed of work rolls varies from one stand to another, and vibrations of plural frequencies are superimposed. It is therefore difficult to detect chattering. That is, a method of identifying a frequency of chattering in advance and detecting a vibration intensity in the frequency band such as the ones disclosed in the conventional arts have a problem that occurrence of chatter marks resulting from minute vibration cannot necessarily be prevented.

The disclosed embodiments were accomplished in view of the above problem, and an object of the disclosed embodiments is to provide a rolling mill abnormal vibration detection method, an abnormality detection apparatus, a rolling method, and a metal strip producing method that make it possible to detect abnormal vibration that causes chatter marks with high accuracy.

Solution to Problem

[1] A method for detecting abnormal vibration of a rolling mill that has a pair of work rolls and a plurality of backup rolls that support the work rolls, the method including: a collecting step of collecting vibration data of the rolling mill; a frequency analysis step of generating first analysis data indicative of vibration intensities at respective frequencies by performing frequency analysis of the vibration data; a data conversion step of converting the first analysis data into second analysis data indicative of vibration intensities at respective intervals on the basis of a rolling speed; and a map generation step of generating a vibration map in which a plurality of the second analysis data are arranged in time series.

[2] The method according to [1], further including a principal component analysis step of performing principal component analysis using reference data indicative of a normal state on the second analysis data and thereby identifying outlier components at respective intervals calculated as a residual of projection of the second analysis data onto the reference data, in which the map generation step further generates an outlier component map in which the outlier components at the respective intervals extracted by the principal component analysis step are arranged in time series.

[3] The method according to [2], in which a plurality of principal components used as the reference data in the principal component analysis step are set so that a cumulative value of contribution ratios of the principal components becomes equal to or larger than a reference contribution ratio when principal component analysis is performed on normal analysis data acquired during rolling performed by the rolling mill in a normal state.

[4] The method according to any one of [1] to [3], in which the rolling mill is a cold rolling mill.

[5] An apparatus for detecting an abnormality of a rolling mill that has a pair of work rolls and a plurality of backup rolls that support the work rolls, the apparatus including: a data collecting unit that collects vibration data of the rolling mill; a frequency analysis unit that generates first analysis data indicative of vibration intensities at respective frequencies by performing frequency analysis of the vibration data; a data conversion unit that converts the first analysis data into second analysis data indicative of vibration intensities at respective intervals on the basis of a rolling speed; and a map generating unit that generates a vibration map in which a plurality of the second analysis data are arranged in time series.

[6] The apparatus according to [5], further including a principal component analysis unit that performs principal component analysis using reference data indicative of a normal state on the second analysis data and thereby identifies outlier components at respective intervals calculated as a residual of projection of the second analysis data onto the reference data, in which the map generating unit further generates an outlier component map in which the outlier components at the respective intervals extracted by the principal component analysis unit are arranged in time series.

[7] A rolling method using the method according to any one of [1] to [4], the rolling method including a backup roll replacement step of setting an interval to be monitored corresponding to the rolling mill in advance and replacing the backup rolls of the rolling mill in a case where a vibration intensity at the interval to be monitored in the vibration map or the outlier component map generated in the map generation step exceeds a preset limit vibration intensity.

[8] A method for producing a metal strip, the method including a step of producing a metal strip by using the rolling method according to [7].

Advantageous Effects

According to the disclosed embodiments, a vibration map in which a plurality of pieces of second analysis data obtained by conversion into vibration intensities at respective intervals are arranged in time series is created. This makes it possible to prevent erroneous detection that occurs due to noise and the like generated from equipment around a rolling mill and extract and evaluate abnormal vibration with high accuracy. As a result, it is possible to operate a rolling mill while preventing or suppressing occurrence of abnormal vibration, prevent or suppress occurrence of a defect on a surface of a metal strip caused by abnormal vibration, and produce a metal strip with good appearance.

DETAILED DESCRIPTION

Figure 1:
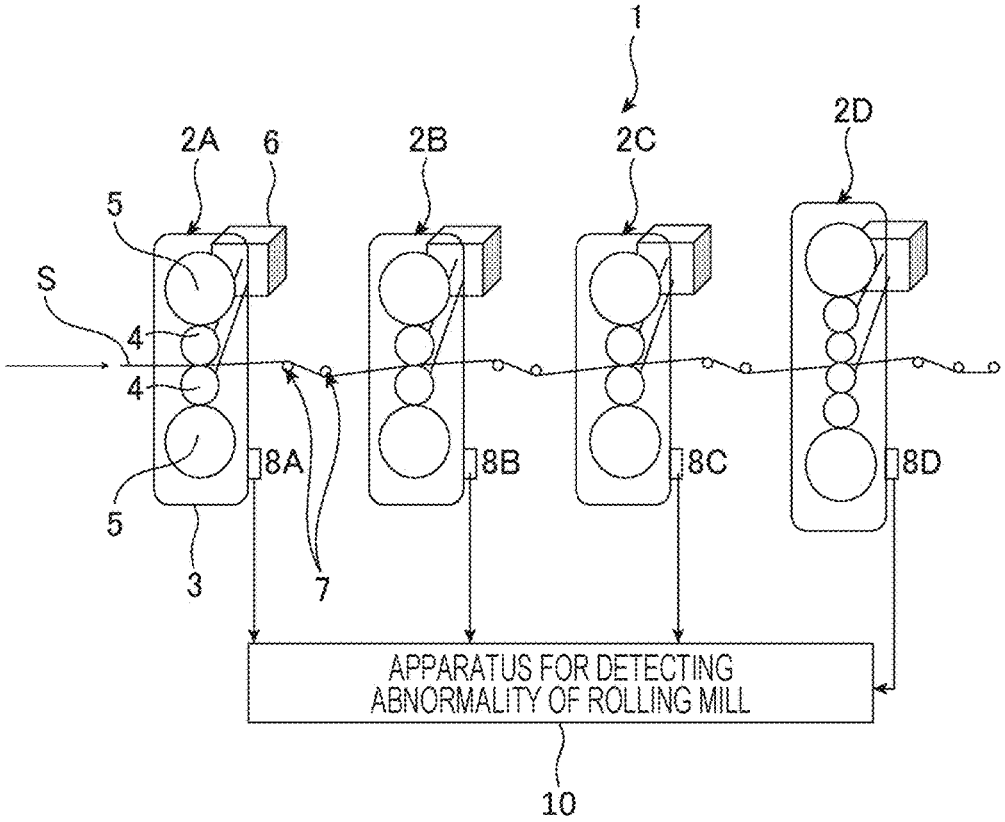
FIG. 1 is a schematic view illustrating an example of rolling equipment to which an apparatus for detecting an abnormality of a rolling mill according to the disclosed embodiments is applied.

A method for detecting abnormal vibration of a rolling mill, an apparatus for detecting an abnormality of a rolling mill, a rolling method, and a method for producing a metal strip according to an embodiment are described below with reference to the drawings. FIG. 1 is a schematic view illustrating an example of rolling equipment to which the apparatus for detecting an abnormality of a rolling mill according to the disclosed embodiments is applied. Rolling equipment 1 of FIG. 1 is, for example, cold rolling equipment that cold-rolls a steel strip that is a metal strip S and includes four rolling mills 2A, 2B, 2C, and 2D (four stands) arranged in a rolling direction. The rolling mills 2A, 2B, 2C, and 2D have an identical configuration, and each include a housing 3, a pair of work rolls 4 that are contained in the housing 3 and roll the metal strip S, a plurality of backup rolls 5 that support the work rolls 4, and a driving device 6 that drives the work rolls 4 to rotate. Furthermore, a small-diameter roll 7 on which the rolled metal strip S is suspended is disposed on a downstream side of each of the rolling mills 2A, 2B, 2C, and 2D in a rolling direction in which the metal strip S is rolled.

Vibration meters 8A, 8B, 8C, and 8D are attached to the housings 3 of the rolling mills 2A, 2B, 2C, and 2D, respectively. The vibration meters 8A, 8B, 8C, and 8D measure vibration occurring in the rolling mills 2A, 2B, 2C, and 2D and comprise, for example, acceleration sensors. Note that positions of the vibration meters 8A, 8B, 8C, and 8D are not limited to the housings 3 and can be any positions where vibration of the rolling mills 2A, 2B, 2C, and 2D can be detected. For example, the vibration meters 8A, 8B, 8C, and 8D may be mounted on roll chocks or the small-diameter rolls 7 on which the rolled metal strip S is suspended.

Specifically, in a case where the vibration meters 8A, 8B, 8C, and 8D are mounted on the small-diameter rolls 7, vibration data acquired by the vibration meters 8A, 8B, 8C, and 8D can be regarded as corresponding to vibration of the rolling mills 2A, 2B, 2C, and 2D disposed on an upstream side relative to the small-diameter rolls 7 on which the vibration meters 8A, 8B, 8C, and 8D are mounted in the rolling direction in which the metal strip S is rolled, respectively. A rolling speed in the present embodiment is a circumferential speed of the work rolls 4 in the rolling mill 2A, 2B, 2C, or 2D or a line speed (exit-side speed) of the metal strip S on an exit side of the rolling mill 2A, 2B, 2C, or 2D. The rolling speed is specified for each of the rolling mills 2A, 2B, 2C, and 2D where the vibration meters 8A, 8B, 8C, and 8D are provided (hereinafter, positions where the vibration meters 8A, 8B, 8C, and 8D are provided are sometimes referred to as stands). In a case where the vibration meters 8A, 8B, 8C, and 8D are mounted on the small-diameter rolls 7, vibration data acquired by the vibration meters 8A, 8B, 8C, and 8D is associated with rolling speeds of the rolling mills 2A, 2B, 2C, and 2D disposed on an upstream side relative to the vibration meters 8A, 8B, 8C, and 8D, respectively. A standard rolling speed in the present embodiment is any rolling speed set for each of the rolling mills 2A, 2B, 2C, and 2D. As the standard rolling speed, a rolling speed empirically recognized as a rolling speed of the rolling mill 2A, 2B, 2C, or 2D at which chattering is likely to occur may be selected. For example, 900 m/min may be selected from a rolling speed range of 800 m/min or higher and 1300 m/min or lower where chattering is likely to occur may be selected as a standard rolling speed for the final stand 2D. In this case, standard rolling speeds for the rolling mills 2A, 2B, and 2C located on an upstream side relative to the final stand 2D may be set on the basis of the standard rolling speed set for the final stand 2D in accordance with a standard pass schedule.

Figure 2:
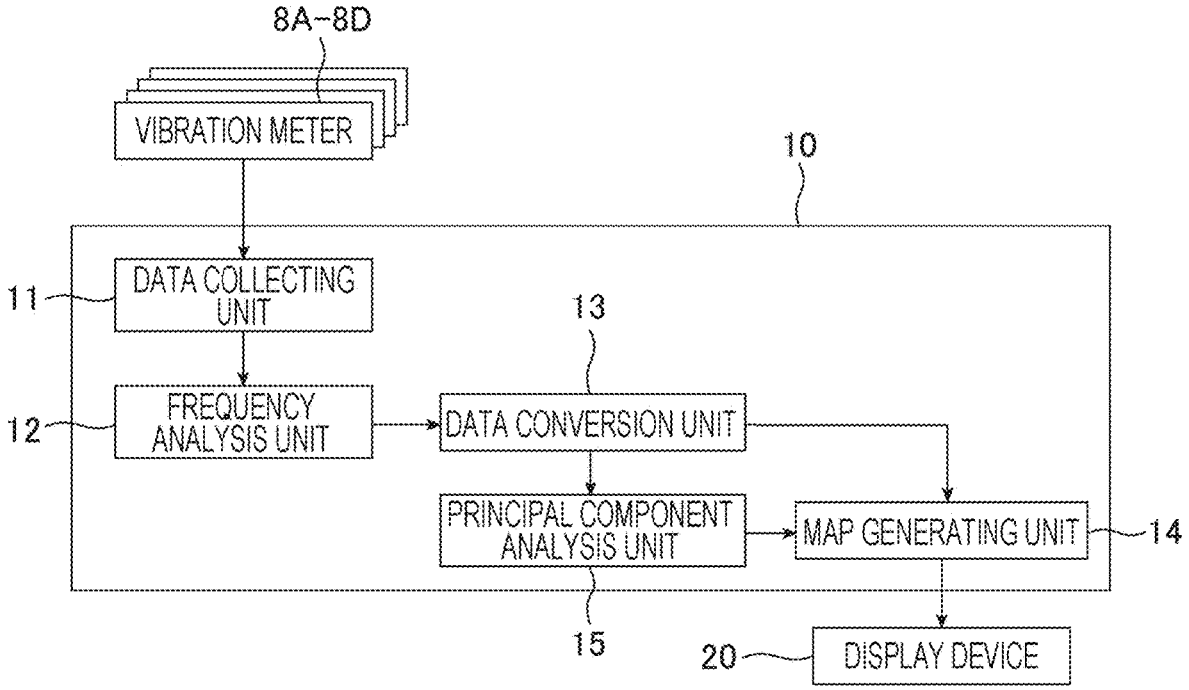
FIG. 2 is a functional block diagram illustrating a preferred embodiment of the apparatus for detecting an abnormality of a rolling mill.

FIG. 2 is a functional block diagram illustrating a preferred embodiment of the apparatus for detecting an abnormality of a rolling mill. Note that a configuration of an apparatus 10 for detecting an abnormality of a rolling mill of FIG. 2 is, for example, constructed by a hardware resource such as a computer. The apparatus 10 for detecting an abnormality of a rolling mill detects abnormal vibration of the rolling mills 2A, 2B, 2C, and 2D that cause chatter marks and includes a data collecting unit 11, a frequency analysis unit 12, a data conversion unit 13, and a map generating unit 14. Furthermore, the apparatus 10 may include a principal component analysis unit 15, which will be described later.

The data collecting unit 11 collects vibration data detected by the vibration meters 8A, 8B, 8C, and 8D. In a case where the vibration meters 8A, 8B, 8C, and 8D are acceleration sensors, acceleration data of vibration is sent to the data collecting unit 11 from the vibration meters 8A, 8B, 8C, and 8D. The data collecting unit 11 continuously acquires acceleration data. Then, the data collecting unit 11 converts acceleration data measured within a preset data sampling period (e.g., a period of 0.2 seconds) among the acquired acceleration data into speed data by time integration, and collects the speed data as vibration data at each time, that is, each data sampling period. As a result, the vibration data becomes vibration speeds arranged in time series.

The data collecting unit 11 performs, for example, measurement for a data sampling period of 0.2 seconds and calculation of vibration data in a preset data acquisition cycle (e.g., every 1 second). In the case of a continuous cold rolling mill, the data sampling period is preferably set to 0.1 seconds or longer and 1 second or shorter, and a data acquisition cycle is preferably set to 1 second or longer and 5 seconds or shorter. If the data sampling period is shorter than 0.1 seconds, there is a possibility that data sufficient to identify vibration of a rolling mill cannot be obtained, and if the data sampling period is longer than 1 second, there is a possibility that a calculation load of frequency analysis and the like becomes high, and therefore the data sampling period is set to avoid these possibilities. If the data acquisition cycle is shorter than 1 second, there is a possibility that a calculation load of frequency analysis and the like becomes high, and if the data acquisition cycle is longer than 5 seconds, there is a possibility that it is difficult to detect abnormal vibration early, and therefore the data acquisition cycle is set to avoid these possibilities. Although a case where the data collecting unit 11 collects vibration data from each of the vibration meters 8A, 8B, 8C, and 8D is illustrated in this example, the data collecting unit 11 may be configured to collect vibration data from any one of the vibration meters 8A, 8B, 8C, and 8D. This is because chattering in the rolling mill (stand) 2A, 2B, 2C, or 2D in which the any one of the vibration meters 8A, 8B, 8C, and 8D is provided can be detected with certainty on the basis of vibration data collected by the any one of the vibration meters 8A, 8B, 8C, and 8D. Note that the vibration meters 8A, 8B, 8C, and 8D are not limited to acceleration sensors and may be position sensors or speed sensors that can measure vibration. This is because acceleration data, speed data, and displacement (displacement amount) data can be converted into one another by time integration or time differentiation.

The frequency analysis unit 12 performs frequency analysis of vibration data collected within the data sampling period by the data collecting unit 11 and generates, for each data acquisition cycle, analysis data (hereinafter sometimes referred to as first analysis data) that includes vibration intensities at respective frequencies. The frequency analysis unit 12 extracts an amplitude and a phase of a vibration speed for each frequency, for example, by Fourier transform and extracts an absolute of an amplitude of a vibration speed at each frequency as a vibration intensity. Note that frequencies after Fourier transform of digital data become discrete values depending on the number of pieces of data subjected to the Fourier transform and a sampling frequency.

In the present embodiment, plural frequencies at which frequency analysis is performed by the frequency analysis unit 12 are set, and these plural frequencies are referred to as reference frequencies. As the reference frequencies, any frequencies may be selected from a frequency band that is ½ or less of a sampling frequency of the vibration meters 8A, 8B, 8C, and 8D. The sampling frequency is the number of times of measurement of vibration (e.g., acceleration) by a vibration meter for 1 second and varies depending on specification of the vibration meter used. In the present embodiment, a lowest sampling frequency among sampling frequencies of the plurality of vibration meters 8A, 8B, 8C, and 8D may be used as a representative value. As the number of reference frequencies, 20 or more and 1600 or less frequencies are preferably selected from a frequency band that is ½ or less of the sampling frequency. If the number of reference frequencies is less than 20, there is a possibility that occurrence of chattering cannot be detected, and if the number of reference frequencies is more than 1600, there is a possibility that a data acquisition cycle needs to be set long so that a calculation load of the frequency analysis unit 12 does not become too high and occurrence of chattering cannot be detected early, and therefore the number of reference frequencies is set to avoid these possibilities. As the number of reference frequencies, 200 or more and 800 or less frequencies are more preferably selected from a frequency band that is ½ or less of the sampling frequency. For example, assume that the sampling frequency of the vibration meters 8A, 8B, 8C, and 8D is 5120 Hz, the frequency analysis unit 12 sets, sets a reference frequency every 5 Hz (number of 400 reference frequencies in total) in a frequency range of 5 Hz or more and 2000 Hz or less, and analyzes a vibration intensity for each reference frequency. Note that a frequency analysis method used by the frequency analysis unit 12 is not limited to Fourier transform and can be any method that can analyze vibration data into vibration intensities at respective frequencies, and a known frequency analysis method such as wavelet transform or windowed Fourier transform can be used. Even in this case, the reference frequencies may be set by a same method as that described above.

The data conversion unit 13 converts analysis data of vibration intensities at respective reference frequencies, that is, first analysis data into vibration intensities at respective intervals (second analysis data) on the basis of a rolling speed. The data conversion unit 13 converts the first analysis data indicative of vibration intensities corresponding to reference frequencies into second analysis data indicative of vibration intensities at respective intervals for each of the rolling mills 2A, 2B, 2C, and 2D in which the vibration meters 8A, 8B, 8C, and 8D are provided (for each of the rolling mills 2A, 2B, 2C, and 2D corresponding to the vibration meters 8A, 8B, 8C, and 8D). An interval in the present embodiment is an index that is associated with a frequency of vibration and corresponds to a distance of the metal strip S in the longitudinal direction or a circumferential distance of the work rolls 4 of the rolling mills 2A, 2B, 2C, and 2D. That is, the interval is an interval between vibration peaks that become adjacent to each other in the longitudinal direction of the metal strip S or the circumferential direction of the work rolls 4 as a result of the data transform by the data conversion unit 13. Specifically, an interval P (mm) is expressed by the following formula by using a rolling speed V (m/min) and a frequency f (Hz) of vibration.

$$P=(1000\times V)/(f\times 60) \quad (1)$$

Note that the above wording "on the basis of a rolling speed" means that the first analysis data is converted by using the rolling speed V as indicated by the formula (1) when the first analysis data is converted into vibration intensities at respective intervals (second analysis data).

In the data conversion unit 13, standard intervals are stored as intervals corresponding to the standard rolling speed. The standard intervals are intervals calculated from the above formula (1) by using the reference frequencies f of the frequency analysis performed by the frequency analysis unit 12 and the standard rolling speed V. The standard intervals thus set are a plurality of discrete numerical values corresponding to the reference frequencies. The standard intervals are used in the present embodiment for the following reason. Specifically, a rolling speed at which a metal strip S is rolled by the rolling mills 2A, 2B, 2C, and 2D is not necessarily be constant, and even when a single metal strip S is rolled, a rolling speed changes within the metal strip S. Therefore, even vibration occurring at an identical interval is measured as vibration of a different frequency if a rolling speed is different. In this case, in a case where vibrations of a plurality of frequency bands are superimposed, it cannot be clearly understood whether or not a cause of vibration is identical in a case where a rolling speed changes. In view of this, the standard intervals are set in order to evaluate a vibration phenomenon generated from an identical vibration source and observed at a frequency that varies depending on a rolling speed by using a unified index. That is, vibration behavior in which a vibration source that generates vibration at a constant interval is observed as vibration of a different frequency because of a different rolling speed is converted into vibration behavior corresponding to the standard rolling speed, and this is expressed as vibration intensities at respective intervals. In this way, a vibration intensity at any rolling speed acquired during actual operation can be evaluated by using a constant index, that is, a vibration intensity corresponding to a standard interval.

The data conversion unit 13 converts vibration intensities at respective reference frequencies (the first analysis data) into vibration intensities at respective standard intervals (the second analysis data) by performing data interpolation such as interpolation or extrapolation. In this case, linear interpolation can be used as the interpolation, and a DC component that is "0" frequency component is interpolated as "0". Furthermore, all frequencies to be extrapolated are handled as "0". In this way, even in a case where a rolling speed varies from one metal strip to another, a frequency at which an abnormality is occurring can be evaluated by using a constant index, that is, a standard interval. Note that in the following description, the term "interval" is used to mean a "standard interval" associated with a reference frequency and a standard rolling speed from a perspective of determining an abnormality of vibration corresponding to a specific interval. That is, the term "interval" means the same as the term "standard interval" unless otherwise specified.

The following describes vibration measured by the vibration meters 8A, 8B, 8C, and 8D provided in the rolling mills 2A, 2B, 2C, and 2D. As vibration measured by the vibration meters 8A, 8B, 8C, and 8D, vibration resulting from rotation of the work rolls 4 and the like and vibration that occurs in a natural period of the rolling mills 2A, 2B, 2C, and 2D are superimposed. The former vibration varies depending on a rolling speed, and the latter vibration is measured as vibration that does not depend on a rolling speed. Therefore, as for the vibration resulting from rotation of the work rolls 4 and the like, when a rolling speed changes, a frequency of vibration measured by the vibration meters 8A, 8B, 8C, and 8D changes. On the other hand, as for a vibration intensity of vibration that occurs in a natural period of the rolling mills 2A, 2B, 2C, and 2D, a magnitude (amplitude) of the vibration intensity often changes although a frequency of the vibration does not change much. Due to such characteristics of vibration of a rolling mill, according to the method of focusing on a specific frequency and detecting abnormal vibration of a rolling mill on the basis of a vibration intensity at this frequency, it is difficult to detect an abnormality related to rotators such as the work rolls 4, the backup rolls 5, and shaft bearing parts thereof in the rolling mills 2A, 2B, 2C, and 2D although an abnormality corresponding to vibration that occurs in a natural period of the rolling mills 2A, 2B, 2C, and 2D can be detected. On the other hand, according to the present embodiment, even in a case where a rolling speed changes, it is easy to detect an abnormality of a vibration system resulting from rotation occurring at a specific interval because of conversion into vibration intensities at respective standard intervals.

The map generating unit 14 generates a vibration map (see FIG. 3, which will be described later) in which a plurality of pieces of second analysis data obtained by conversion into vibration intensities at respective intervals generated by the data conversion unit 13 are arranged in time series. By thus generating and displaying such a vibration map, it is possible to detect occurrence or a symptom of abnormal vibration resulting from rotators of the rolling mills 2A, 2B, 2C, and 2D that causes chatter marks. In particular, in a case where abnormal vibration occurs or progresses, it can be visually understood that a vibration intensity corresponding to a specific interval increases over passage of time by referring to the vibration map. Therefore, it is possible to clearly recognize occurrence of abnormal vibration as compared with a detection method using only amplitude information at a current time measured by the vibration meters 8A, 8B, 8C, and 8D. Note that the vibration map is preferably generated by arranging vibration intensities at respective intervals generated for each data acquisition cycle in time series. Note, however, that it is unnecessary to arrange all vibration intensities for each data acquisition cycle, and the vibration intensities with constant intervals may be thinned out and displayed.

The vibration map is generated by the map generating unit 14 in the present embodiment for the following reason. Specifically, chattering (vibration of the rolling mills 2A, 2B, 2C, and 2D) that causes chatter marks often occurs at a constant interval due to rotary motion of a device that constitutes the rolling mills 2A, 2B, 2C, and 2D. For example, in a case where a flaw occurred at a reduction gear that drives the rolling mills 2A, 2B, 2C, and 2D, an interval is constant even in a case where a rolling speed changes although a frequency of vibration changes depending on the rolling speed. Furthermore, in a case where an uneven shape is formed in the circumferential direction of the backup roll 5, specifically, in a case where, for example, the backup roll 5 is worn out or deformed to have a polygonal shape, an interval of chatter marks on a surface of the backup roll 5 does not change depending on a rolling speed although a frequency of vibration changes depending on the rolling speed. Therefore, occurrence or the like of abnormal vibration can be detected by grasping the interval of the chatter marks and continuously monitoring a vibration intensity. However, actually, an uneven shape (e.g., a minute mark) on a surface of the backup roll 5 is invisible or has not appeared on the surface of the backup roll 5 before the backup roll 5 is incorporated into the rolling mills 2A, 2B, 2C, and 2D, and the interval of the chatter marks cannot be predicted. Furthermore, an interval observed as abnormal vibration varies between a case where a flaw occurs on a surface of a rotator and a case where a rotator has changed to a polygonal shape although abnormal vibration resulting from a rotary motion occurs in both cases, and therefore the interval of the chatter marks cannot be predicted.

In view of this, according to the disclosed embodiments, frequency analysis and data conversion of vibration data are performed at constant time intervals (in a data acquisition cycle), and a vibration map in which relationships between intervals and vibration intensities are arranged in time series is generated by the map generating unit 14. As a result, it can be visually understood from the vibration map that a vibration intensity of an interval of chatter marks gradually increases over passage of time. That is, even if an interval of chatter marks cannot be predicted, occurrence of abnormal vibration can be grasped and detected by visually grasping a change in vibration intensity on the vibration map. Such a vibration map is generated for each of the vibration meters 8A, 8B, 8C, and 8D provided in the rolling mills 2A, 2B, 2C, and 2D. Furthermore, since a vibration intensity depends on a wavelength (interval) and a time, each vibration map is displayed three-dimensionally. The map generating unit 14 may generate a vibration map whose vertical axis represent an interval and whose horizontal axis represents a time while dividing values of vibration intensities into sections and allocating a color to each section. The vibration map generated by the map generating unit 14 is displayed on a display device 20 in an operation room where operation of the rolling mills 2 is managed. Since it can be determined whether or not a vibration intensity corresponding to a specific interval is large by referring to the vibration map, abnormal vibration can be detected early.

Note that there exists a rolling speed that is likely to cause vibration in the rolling mills 2A, 2B, 2C, and 2D in some cases. For example, there are cases where resonance occurs due to vibration resulting from rotary motion of a rotator of the rolling mills 2A, 2B, 2C, and 2D and vibration resulting from vibration that occurs in a natural period of the rolling mills 2A, 2B, 2C, and 2D. In such cases, contents displayed by the vibration map are preferably selected corresponding to a rolling speed. By these methods, it can be determined that a mark on the backup roll 5 is developing as for a vibration peak that is not initially clear at a specific interval on the vibration map and increases over passage of several hours to several days.

Furthermore, the map generating unit 14 may have a function of performing principal component analysis on the second analysis data of vibration intensities corresponding to standard intervals generated by the data conversion unit 13 and generating an outlier component map on the basis of a result of the principal component analysis in addition to the function of generating a vibration map.

The apparatus 10 may further include a principal component analysis unit 15 that performs principal component analysis using reference data indicative of a normal state on the second analysis data of vibration intensities at respective standard intervals obtained by conversion by the data conversion unit 13 and identifies outlier components at respective intervals calculated as residuals of projection (evaluation data) of the second analysis data onto the reference data. The evaluation data is data obtained by projecting observation data (the second analysis data in the present embodiment) onto a space constituted by principal component vectors. That is, the evaluation data is identified by scalar quantities in which the observation data is projected in directions of a plurality of principal component vectors and is constituted by the same number of pieces of scalar quantity information as the number of principal component vectors. The principal component vectors (reference data) applied to the principal component analysis will be described later. Note that the "principal component analysis" may mean both analysis of synthesizing a small number of uncorrelated variables called principal components that express overall dispersion the best from a large number of correlated variables and calculation of projection of observation data onto a space constituted by a preset principal component vectors, but the principal component analysis performed by the principal component analysis unit 15 according to the present embodiment means the latter. That is, the principal component analysis unit 15 according to the present embodiment has a function of calculating projection (evaluation data) of the second analysis data onto a space constituted by principal component vectors (reference data) indicative of a preset normal state and identifies a difference between the second analysis data and projection (evaluation data) of the second analysis data as an outlier component.

First to i-th principal components (reference data) set as the principal component vectors used for the principal component analysis performed by the principal component analysis unit 15 are set on the basis of vibration intensities at respective standard intervals (reference vibration data) obtained during a normal time where abnormal vibration is not occurring in the rolling mills 2A, 2B, 2C, and 2D. A principal component deriving unit 16, which will be described later, generates the reference data by performing principal component analysis on the reference vibration data. Note that the principal component analysis performed by the principal component deriving unit 16 means analysis of synthesizing a small number of uncorrelated principal component vectors that express overall dispersion the best from a large number of correlated variables. The normal time where abnormal vibration is not occurring in the rolling mills 2A, 2B, 2C, and 2D refers to a state where abnormal vibration is not occurring in any of the rolling mills 2A, 2B, 2C, and 2D at a standard rolling speed. Note that the abnormal vibration will be described later. The reference vibration data is, for example, data obtained by performing the frequency analysis on vibration data measured during rolling within 12 hours from replacement of the backup rolls 5 with new ones and converting the data subjected to the frequency analysis into vibration intensities at respective intervals. The reference vibration data is sometimes referred to as normal analysis data that is data obtained by analysis of normal vibration behavior that does not cause abnormal vibration. The reference vibration data may be data obtained by analyzing vibration data measured during rolling within 24 hours from replacement of the backup rolls 5 with new ones. This is because it is empirically known that it takes at least two days for the backup rolls 5 to wear out to a polygonal shape and abnormal vibration does not occur for about two days after replacement of the backup rolls 5 with new ones. A data sampling period for acquisition of the reference vibration data is preferably set identical to a data sampling period for detection of an abnormality during operation (after elapse of 24 hours from replacement of the backup rolls 5 with new ones). A data acquisition cycle for acquisition of the reference vibration data and a data acquisition cycle for acquisition of vibration data during operation may be different.

The reference vibration data is generated for each data acquisition cycle during a normal time, and vibration intensities at respective standard intervals acquired within a data sampling period is handled as a single data set. Accordingly, the reference vibration data includes a plurality of data sets. The number of data sets included in the reference vibration data is preferably 30,000 or more and 200,000 or less. Principal component vectors are derived by principal component analysis using the standard intervals as variables by using the reference vibration data thus acquired, and the principal component vectors are referred to as reference data. Specifically, by the principal component analysis performed by the principal component deriving unit 16, which will be described later, a small number of uncorrelated principal components that express overall dispersion the best are derived from a plurality of correlated pieces of reference vibration data, a cumulative value of contribution ratios is calculated by accumulating contribution ratios of principal components in a descending order of a contribution ratio for representing a feature quantity of the reference vibration data, and i principal components selected until the calculated cumulative value (cumulative contribution ratio) reaches a preset value are used as the reference data. Hereinafter, the preset cumulative contribution ratio is referred to as a reference contribution ratio or a set contribution ratio. The reference contribution ratio in the present embodiment can be set to any value that is equal to or less than 1 (100%). In the case of a typical tandem rolling mill, the reference contribution ratio is preferably set as 0.4 (40%) or more and 0.7 (70%) or less, more preferably 0.6 (60%) or more and 0.7 (70%) or less. The reference contribution ratio is an index that influences a degree of reproduction (reproducibility) of vibration behavior of the reference vibration data on a principal component space. If the reference contribution ratio is too high, measurement noise and the like included in the reference vibration data are also reproduced on the principal component space although the vibration behavior of the reference vibration data can be reproduced accurately on the principal component space. On the other hand, if the reference contribution ratio is too low, a feature concerning the vibration behavior of the reference vibration data tends to be lost on the principal component space although influence of measurement noise included in the reference vibration data can be excluded. A suitable range of the reference contribution ratio depends on a rolling mill used and a steel sheet rolling condition, but is preferably set to the above range for the purpose of detecting abnormal vibration of a tandem rolling mill.

Figure 6:
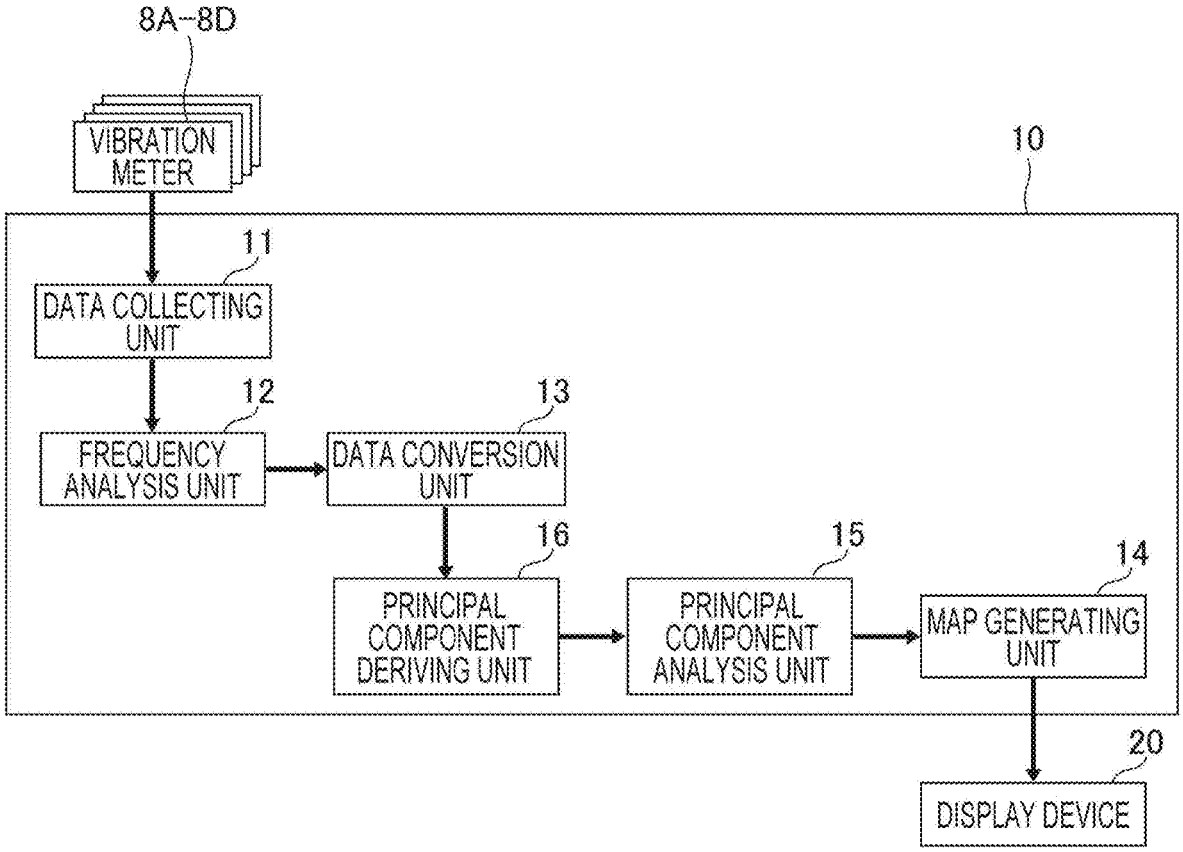
FIG. 6 is a functional block diagram illustrating another preferred embodiment of the apparatus for detecting an abnormality of a rolling mill.

To derive the reference data, the apparatus 10 may include the principal component deriving unit 16 that derives a principal component by using the reference vibration data (normal analysis data) generated by the data conversion unit 13, as illustrated in FIG. 6. The principal component deriving unit 16 performs analysis of identifying a small number of uncorrelated principal component vectors that expresses overall dispersion the best from a plurality of correlated pieces of reference vibration data. The first to i-th principal components (the reference data) obtained by the principal component deriving unit 16 may be temporarily stored in a storage unit (not illustrated) and then sent to the principal component analysis unit 15 during operation, and the principal component analysis unit 15 may calculate projection (evaluation data) of the second analysis data acquired during operation onto the first to i-th principal components. Furthermore, in a case where an interval at which chatter marks are likely to occur in the rolling mills 2A, 2B, 2C, and 2D is known in advance, plural standard intervals similar to the interval may be selected in advance and the number of variables used for the principal component analysis by the principal component analysis unit 15 may be decreased when the principal component deriving unit 16 derives a principal component.

The principal component analysis unit 15 performs principal component analysis for calculating evaluation data for the second analysis data indicative of vibration intensities at respective standard intervals acquired during operation by using the first to i-th principal components (the reference data) calculated by the principal component deriving unit 16. Specifically, the principal component analysis unit 15 separates the second analysis data indicative of vibration intensities at respective standard intervals acquired during operation into projection onto the first to i-th principal components that are the reference data and a residual part obtained by subtracting the projection onto the principal components of the reference data from the second analysis data, and identifies the residual part as an outlier component. The outlier component is sometimes referred to as an outlier degree or a Q statistic. Since the outlier component calculated by the principal component analysis unit 15 is an index indicative of deviation from vibration behavior during a normal time, abnormal vibration of the rolling mills 2A, 2B, 2C, and 2D can be easily detected by monitoring the outlier component.

The map generating unit 14 may have a function of generating an outlier component map on the basis of outlier components at respective intervals calculated by the principal component analysis unit 15. That is, the map generating unit 14 generates a vibration map in which outlier components at respective intervals calculated by the principal component analysis unit 15 are arranged in time series. In the present embodiment, a vibration map thus generated is referred to as an outlier component map. The outlier component map is a map in which outlier components obtained by the principal component analysis unit 15 are arranged in time series, and since an outlier component is sometimes calculated as a negative value, such an outlier component is preferably displayed as "0 (zero)". This is because a negative outlier component means that vibration during operation is smaller than that during a normal time and does not indicate abnormal vibration. The outlier component map makes it easy to visually recognize that abnormal vibration is occurring.

The map generating unit 14 may generate an outlier component map (see FIGS. 4 and 5, which will be described later) whose vertical axis represents an interval and whose horizontal axis represents a time while separating values of outlier components into sections and allocating a color to each section. The outlier component map generated by the map generating unit 14 is displayed on the display device 20 in an operation room where operation of the rolling mills 2 is managed. Since it can be determined whether or not an outlier component is large by referring to the outlier component map, abnormal vibration can be detected early. Alternatively, the map generating unit 14 may generate a three-dimensional outlier component map (see FIG. 3, which will be described later) whose x-axis represents a time, whose y-axis represents an interval, and whose z-axis represents an outlier component. This makes it possible to easily understand that abnormal vibration has a tendency to gradually increase.

Figure 7:
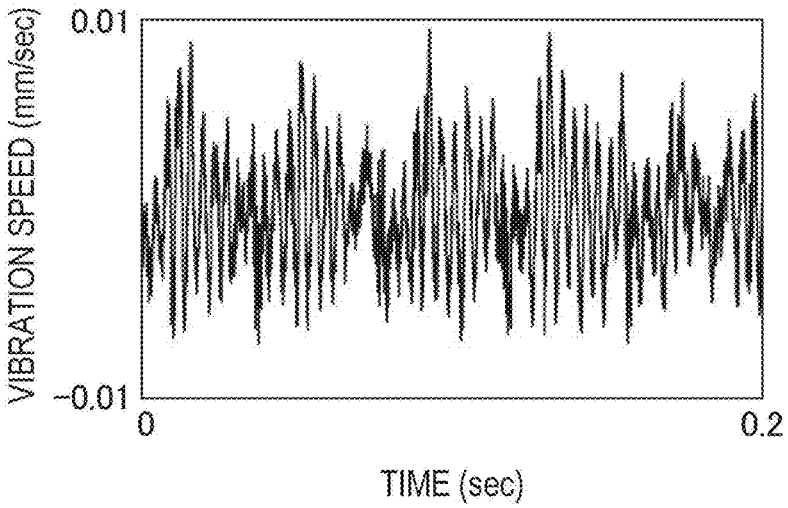
FIG. 7 illustrates an example of time-series vibration data collected by any one of a plurality of vibration meters in a collecting step.
Figure 8:
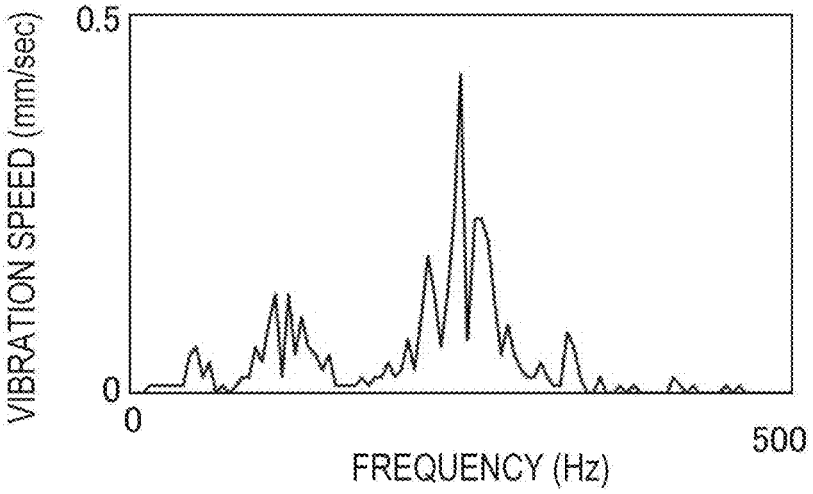
FIG. 8 illustrates an example of vibration intensities at respective frequencies generated in a frequency analysis step.

An operation according to an embodiment is described with reference to FIGS. 1 and 2. First, vibration of the rolling mills 2A, 2B, 2C, and 2D during cold rolling (during operation) is measured by the vibration meters 8A, 8B, 8C, and 8D, and vibration data is collected by the data collecting unit 11 (collecting step). FIG. 7 illustrates an example of time-series vibration data collected by any one of the vibration meters 8A, 8B, 8C, and 8D in the collecting step. The vibration data is data obtained by converting accelerations acquired from the vibration meters 8A, 8B, 8C, and 8D during a data sampling period of 0.2 sec into vibration speeds. Then, the frequency analysis unit 12 performs frequency analysis of the vibration data, and thereby first analysis data indicative of vibration intensities at respective frequencies is generated (frequency analysis step). FIG. 8 illustrates an example of vibration intensities at respective frequencies generated in the frequency analysis step. Furthermore, the data conversion unit 13 converts the first analysis data into second analysis data indicative of vibration intensities at respective intervals (data conversion step).

Figure 9:
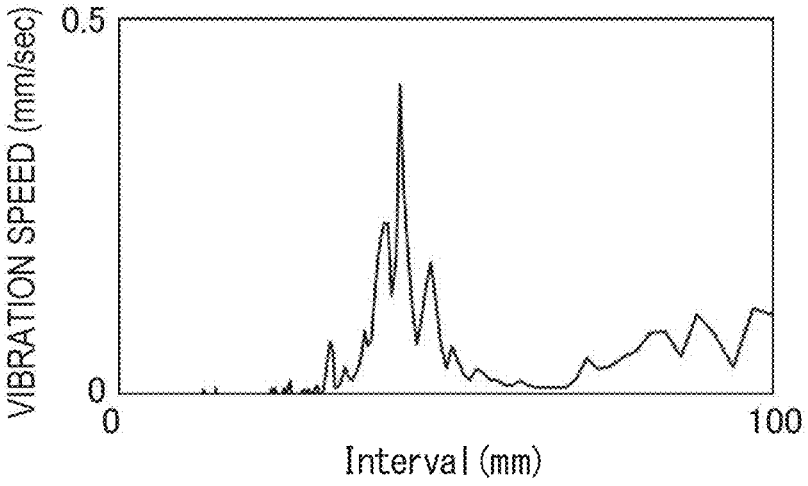
FIG. 9 illustrates an example of second analysis data indicative of vibration intensities at respective intervals obtained by conversion in a data conversion step.
Figure 10:
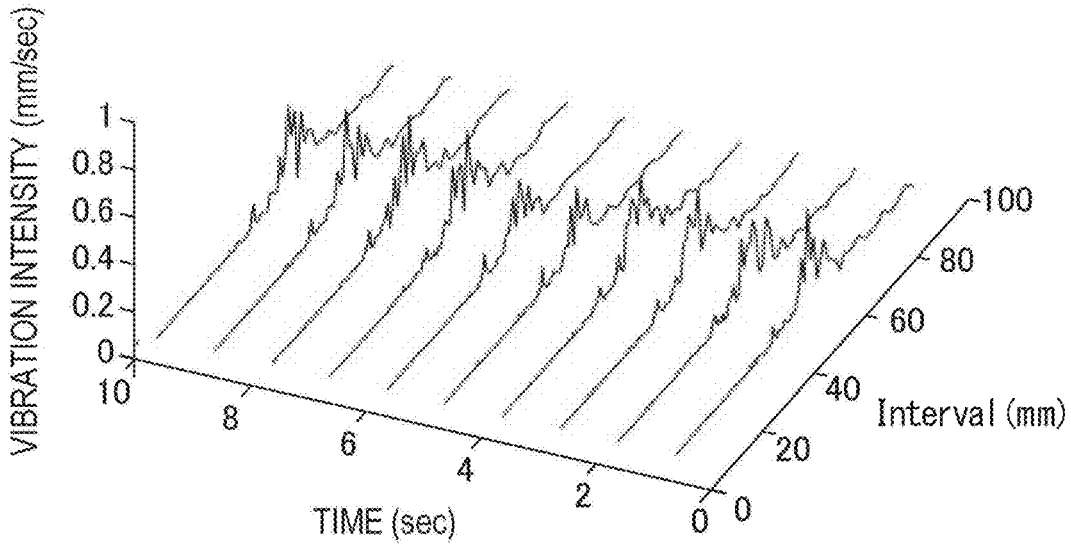
FIG. 10 illustrates an example of a vibration map generated in a map generation step.

FIG. 9 illustrates an example of the second analysis data indicative of vibration intensities at respective intervals obtained in the data conversion step. The data conversion from the first analysis data into the second analysis data in the data conversion step is performed every data acquisition cycle. Then, a vibration map in which a plurality of pieces of vibration data (the second analysis data) converted into vibration intensities at respective intervals are arranged in time series is generated, and the vibration map is updated as needed (map generation step). FIG. 10 illustrates an example of the vibration map generated in the map generation step. This vibration map is one in which the second analysis data indicative of vibration intensities at respective intervals are arranged at preset time intervals in time series.

According to the above embodiment, abnormal vibration of the rolling mills 2A, 2B, 2C, and 2D that causes chatter marks can be detected with high accuracy. Furthermore, principal component analysis using reference data indicative of a normal state is performed on the second analysis data indicative of vibration intensities at respective intervals generated in the data conversion step is performed (principal component analysis step). In this way, outlier components at respective intervals are calculated as a residual of projection of the second analysis data onto the reference data. By thus identifying, as principal component vectors representing a feature quantity of the reference vibration data during a normal time, a vibration component that naturally occurs due to a property unique to equipment such as engagement of gears of the rolling mills 2A, 2B, 2C, and 2D and a vibration characteristic of bearings of the rolling mills 2A, 2B, 2C, and 2D, analysis that emphasizes only abnormal vibration can be performed.

Specifically, abnormal vibration of the rolling mills 2A, 2B, 2C, and 2D is often natural vibration of the rolling mills 2A, 2B, 2C, and 2D or vibration resulting from rotation of a device caused by a defective bearing, engagement of gears, defective coupling, backlash, or the like. Therefore, conventional abnormal vibration detection is performed on the basis of whether or not an amplitude of a specific frequency exceeds a certain threshold value. On the other hand, in a case where chatter marks occur, minute vibration occurs at a frequency corresponding to an interval of the chatter marks before occurrence of the chatter marks. The vibration gradually increases with passage of time, and a defect on a surface of the metal strip S caused by the vibration gradually grows accordingly. That is, minute vibration resulting from equipment occurs first, and then chatter marks occur on a surface of the metal strip S. However, during actual operation, a rolling speed changes within a single metal strip S in the longitudinal direction, and the rolling speed also varies from one metal strip S to another. Therefore, just by focusing on a specific frequency, it is difficult to detect minute vibration that has not reached abnormal vibration yet. On the other hand, in the present embodiment, the first analysis data indicative of vibration intensities at respective frequencies are converted into the second analysis data indicative of vibration intensities at respective standard intervals, and a vibration map or an outlier component map is generated on the basis of the second analysis data in the map generation step. Therefore, a situation where vibration corresponding to a specific interval gradually increases can be visually recognized early.

By using the above method for detecting abnormal vibration of the rolling mills 2A, 2B, 2C, and 2D, a standard interval to be monitored (hereinafter referred to as an interval to be monitored) may be set for each of the rolling mills 2A, 2B, 2C, and 2D, and a rotator that causes abnormal vibration of a rolling mill such as the backup rolls 5 of the rolling mills 2A, 2B, 2C, and 2D may be replaced in a case where a vibration intensity at the set interval to be monitored exceeds a preset limit vibration intensity (support roll replacement step). The interval to be monitored is an interval at which chatter marks are likely to occur on a surface of the metal strip S when the metal strip S is rolled, and the interval to be monitored can be found based on experience or an experiment. Specifically, since chatter marks are a periodic pattern defect occurring on a surface of the metal strip S, an interval of the chatter marks can be specified in a step of inspecting the metal strip S. Therefore, the interval of the chatter marks specified in the inspection step may be set as the interval to be monitored. As the interval to be monitored, a specific numerical value may be set or a numerical value range of intervals where chatter marks occur may be set. For example, in a case where an interval at which chatter marks are likely to occur is 30 mm, a numerical range of ±10%, specifically, a numerical range of 27 mm or more and 33 mm or less may be set as the interval to be monitored. The range of the interval to be monitored need just be decided in consideration of a variation of an interval of chatter marks grasped based on experience from actual operation of the rolling mills 2A, 2B, 2C, and 2D.

The limit vibration intensity means a vibration intensity at which a defect that occurs on a surface of the metal strip S due to vibration of the rolling mills 2A, 2B, 2C, and 2D can pose a problem in quality of the metal strip S as a product. That is, the limit vibration intensity means an upper-limit value of an allowable vibration intensity as vibration occurring in the rolling mills 2A, 2B, 2C, and 2D. Specifically, when excessive vibration occurs at a specific interval, there is a possibility that chatter marks occur on the metal strip S and the metal strip S has defective appearance. It is therefore only necessary to acquire past result data of vibration intensities at respective intervals in advance and set, as the limit vibration intensity, an upper-limit value of a vibration intensity that does not pose a problem in quality of the metal strip S as a product on the basis of a product shipment standard of the metal strip S and the past result data of the vibration intensities. Note that vibration that can pose a problem in quality of the metal strip S as a product, that is, vibration that exceeds the limit vibration intensity corresponds to abnormal vibration of the rolling mills 2A, 2B, 2C, and 2D in an embodiment. A state where no vibration is occurring or a state where vibration is occurring but has not reached abnormal vibration yet corresponds to a normal time or a normal state of the rolling mills 2A, 2B, 2C, and 2D in the embodiment.

Then, a vibration map or an outlier component map is generated on the basis of the interval to be monitored and the limit vibration intensity by the above method for detecting abnormal vibration of the rolling mills 2A, 2B, 2C, and 2D. In a case where a vibration intensity at the interval exceeds the limit vibration intensity in the vibration map or the outlier component map, operation of the rolling mills 2A, 2B, 2C, and 2D is stopped once, and a rotator that causes abnormal vibration of the rolling mill 2A, 2B, 2C, or 2D in which the abnormal vibration has occurred is replaced. In particular, a cause of abnormal vibration of a rolling mill is often the backup rolls 5 of the rolling mill 2A, 2B, 2C, or 2D, the backup rolls 5 of a stand in which abnormal vibration has occurred need just be replaced. This makes it possible to operate the rolling mills 2A, 2B, 2C, and 2D while preventing abnormal vibration occurring at a specific interval even in a case where a plurality of metal strips S are rolled for a long term. Furthermore, it is possible to produce a metal strip S with good appearance having no chatter mark on a surface thereof by such rolling.

Furthermore, a vibration source of abnormal vibration that causes chatter marks is often minute marks of a same interval as chatter marks that occur on a surface of an upper or lower one of the backup rolls 5. In this case, if vibration resulting from the minute marks on the backup roll 5 and vibration of the rolling mill 2A, 2B, 2C, or 2D resonate at a predetermined rolling speed, the minute marks gradually become clear, and vibration of the rolling mill 2A, 2B, 2C, or 2D becomes larger. In view of this, in the embodiment, frequency analysis of vibration data is performed at constant time intervals (every data acquisition cycle), and a relationship between frequencies and vibration intensities in the constant time interval is calculated. Then, the frequencies are converted into standard intervals on the basis of a rolling speed, and a relationship between the standard intervals and the vibration intensities is generated and displayed as a vibration map so that the relationship can be monitored over time.

The vibration data includes vibration caused by many other factors that cause vibration of a constant interval such as a meshing frequency of bearings or gears, and therefore a clear vibration peak of chatter marks is not obtained from the start. In view of this, an outlier component map in which a vibration peak of chatter marks is distinguished from other factors may be generated by using a principal component analysis method.

EXAMPLES

Examples of the disclosed embodiments are described below.

Example 1

In Example 1, a tandem rolling mill including five rolling mills (five stands) was used, and a vibration meter including a piezoelectric element was attached to an upper part of a housing on an operator side and an upper part of the housing on a motor side of each of the rolling mills. Various sample materials such as ultralow-carbon steel and high-tensile steel were used, and plural coils having an entry-side thickness of 2 mm or more and 5 mm or less, an exit-side thickness of 0.6 mm or more and 2.4 mm or less, and a width of 850 mm or more and 1880 mm or less were used. Discrimination of abnormal vibration that causes chatter marks was performed on the basis of vibration data measured in a housing of a rolling mill of a final stand (a fifth stand located on a most downstream side in a direction in which a steel sheet was rolled). Specifically, vibration data was collected by the data collecting unit 11 while setting a data sampling period to 0.2 sec and setting a data acquisition cycle to 1 sec. Then, vibration data (first analysis data) subjected to Fourier transform by the frequency analysis unit 12 was converted into vibration intensities at respective standard intervals (second analysis data) by the data conversion unit 13.

In Example 1, of the two vibration meters provided in the final stand, abnormality detection was performed by using the vibration meter provided on the upper part of the housing on the operator side. In the present Example, the principal component analysis unit 15 calculated outlier components for the vibration intensities at respective standard intervals generated by the data conversion unit 13, and the map generating unit 14 generated an outlier component map. Furthermore, a frequency was selected every 5 Hz in a frequency band of 0 Hz to 1000 Hz with respect to a sampling frequency 2000 Hz of the vibration meter, and these frequencies were used as reference frequencies. A standard rolling speed was set to 600 m/min. In this way, 201 intervals were set as the standard intervals. Furthermore, reference vibration data was collected within two days after replacement of backup rolls of the tandem rolling mill with new ones, 22 principal components (reference data) were derived by the principal component deriving unit 16, and the principal components were stored in the principal component analysis unit 15. After the reference vibration data was collected, vibration data during operation of the tandem rolling mill was collected, outlier components were calculated as needed by the principal component analysis unit 15, the outlier component map was updated as needed by the map generating unit 14, and the outlier component map was displayed on the display device 20 in an operation room for the tandem rolling mill.

Figure 3:
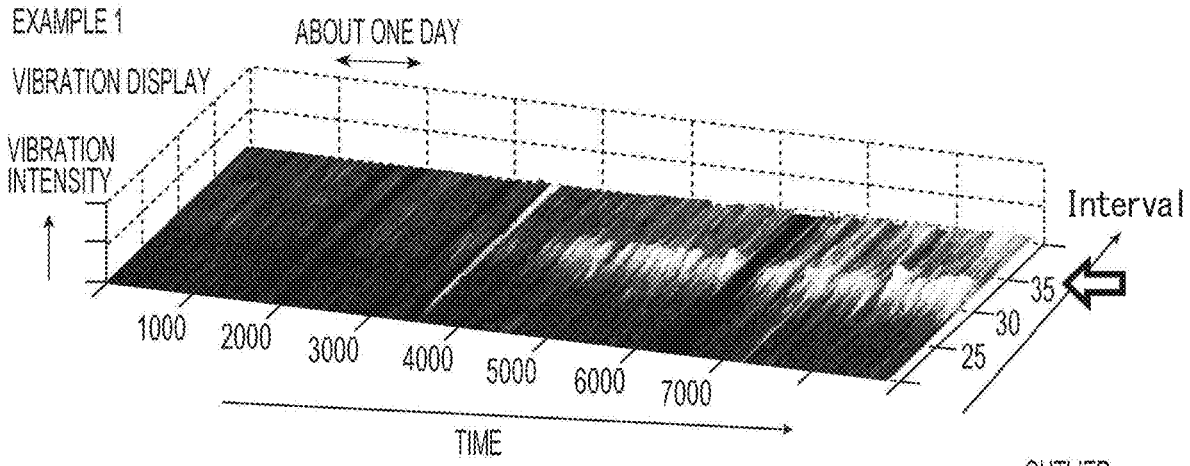
FIG. 3 illustrates an example of an outlier component map in Example 1.

FIG. 3 illustrates an outlier component map generated on the basis of vibration data and a rolling speed during operation of the final stand as an example of the outlier component map in Example 1. In FIG. 3, principal component analysis and extraction of outlier components were performed for vibration data of a rolling length of approximately 5600 km for about two weeks after completion of collection of the reference vibration data, that is, for a rolling period of about nine days, and data in a time-axis direction was thinned out so that the data was displayed every 100 sec. In FIG. 3, the data also includes data at a time of passage of a welded point where adjacent coils are joined, and therefore occurrence of large vibration throughout all intervals can be observed occasionally. Furthermore, FIG. 3 shows that a vibration intensity increases over passage of time, that is, abnormal vibration grows over passage of time at a specific interval (a standard interval; an interval indicated by the arrow with a black edge and a white inner part in FIG. 3). Actually, when rolling was continued even after acquisition of the data, chatter marks occurred at this standard interval one day later.

Example 2

In Example 2, a tandem rolling mill including four stands was used, and a vibration meter including a piezoelectric element was attached to an upper part of a housing on an operator side and an upper part of the housing on a motor side of each of the stands. A steel type, a steel sheet thickness, and a sheet width were identical to those in Example 1, and a rolling amount was similar to that in Example 1. Discrimination of abnormal vibration that causes chatter marks was performed on the basis of data of a vibration meter provided on the upper part of the housing on the operator side of the third rolling mill (third stand) from an upstream side in a direction in which a steel sheet was rolled. A data sampling period, a data acquisition cycle, and reference frequencies were identical to those in Example 1. However, vibration at a frequency equal to or higher than a frequency at which vibration was undetectable due to a property of the housing was ignored.

Figure 4:
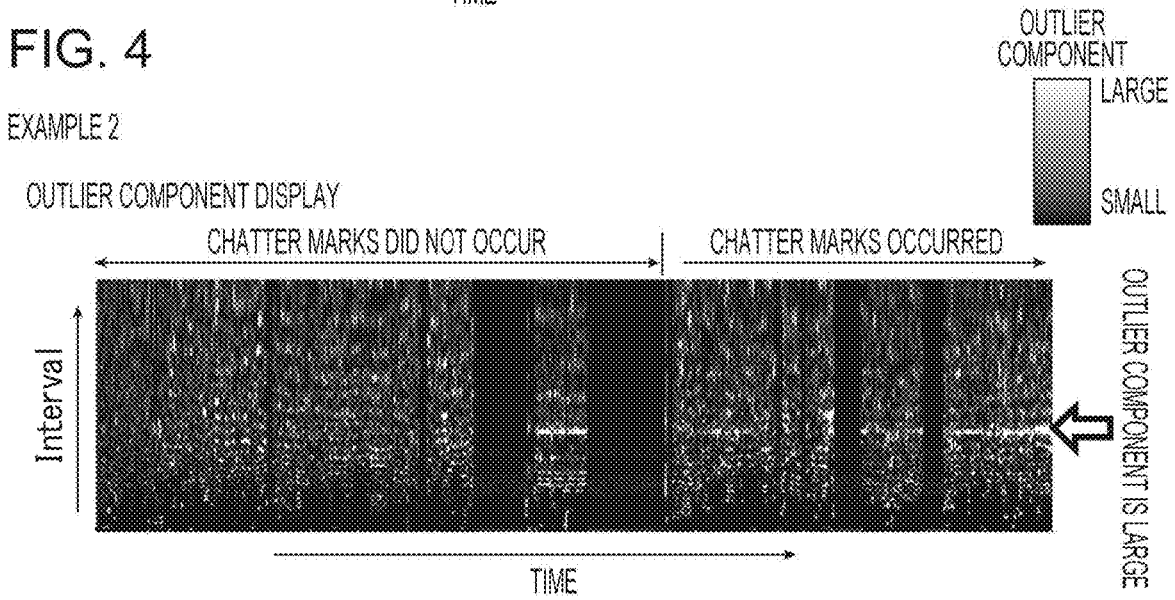
FIG. 4 illustrates an example of an outlier component map in Example 2.

FIG. 4 illustrates an example of an outlier component map in Example 2, specifically, an example of an outlier component map obtained from operation data including all rolling speed without limiting a condition of a rolling speed during operation. In FIG. 4, an outlier degree is expressed by a density. In this outlier component map, a period where no chatter mark occurred and a period where chatter marks occurred are displayed. In principal component analysis, data for one day after replacement of backup rolls among samples was used as reference vibration data. As for vibration data during a normal time, rolling speeds were divided every 50 mpm (m/min) into sections, the reference frequencies were converted into standard intervals by using the rolling speeds thus separated, and a standard interval was set for each section of rolling speeds. In this way, a principal component (reference data) was derived for each section of a rolling speed. A set contribution ratio was set to "0.5" for each rolling speed, and a plurality of principal components to be extracted as reference data were selected for each section of rolling speeds. In this way, principal components associated with each section of rolling speeds were stored in the principal component analysis unit 15. Then, the principal component analysis unit 15 calculated outlier components corresponding to respective standard intervals for vibration data (second analysis data) of the rolling mill during operation. In the calculation of outlier components by the principal component analysis unit 15, principal components corresponding to a rolling speed during operation were selected, and outlier components were calculated as needed for data during operation for each rolling speed by using the selected principal components. Although an outlier degree of a standard interval can take a negative value, such a negative value is displayed as "0" in FIG. 4.

In FIG. 4, a large outlier component is observed before appearance of chatter marks at an interval at which chatter marks appeared. Although a large outlier degree is sometimes observed in other parts, the large outlier component at this interval is always observed even after elapse of time, and it is therefore visually clear that this indicates abnormal vibration.

Figure 5:
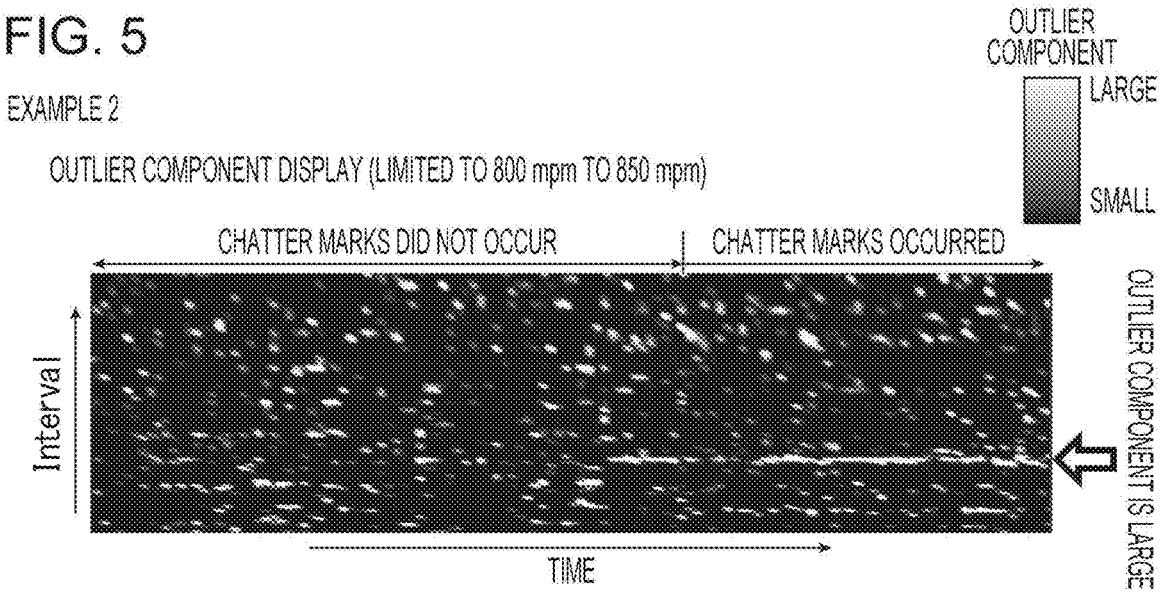
FIG. 5 illustrates an example of an outlier component map in which a rolling speed is 800 mpm or more and 850 mpm or less in Example 2.

FIG. 5 illustrates an outlier component map generated from vibration data during operation acquired while limiting a rolling speed to a range of 800 mpm or more and 850 mpm or less in Example 2. By creating and displaying an outlier component map in which the rolling speed is limited such as the one illustrated in FIG. 5, it can be determined that vibration is abnormal even before occurrence of chatter marks, and a measure can be taken before occurrence of chatter marks.

The disclosure is not intended to be limited to the above embodiment and can be changed in various ways. For example, although a case where three-dimensional display is performed by using a color density associated with an outlier component is illustrated in FIG. 3, this is not restrictive. For example, a display method using a designated color for each vibration intensity may be used or both of the method of performing three-dimensional display by using a color density and the display method using a designated color for each vibration intensity may be used. By these methods, for example, whether a mark on a backup roll is developing can be determined concerning a vibration peak that increases over passage of several hours to several days at an interval where vibration is not initially clear. Furthermore, although a case where the metal strip S is a cold-rolled steel sheet is illustrated in the embodiment, the metal strip S may be a stainless steel material or may be a hot-rolled steel sheet. Furthermore, the rolling mills 2A, 2B, 2C, and 2D need not have an identical configuration, and may include, for example, both a four-high rolling mill and a six-high rolling mill.

Example 3

In Example 3, detection of abnormal vibration of a rolling mill was performed by using the tandem rolling mill used in Example 1 under similar conditions to those in Example 1.

Note that Example 3 is an example in which a vibration map was generated by the map generating unit 14 on the basis of analysis data of vibration intensities at respective intervals generated by the data conversion unit 13 without using the principal component analysis unit 15, unlike Examples 1 and 2.

Figure 11:
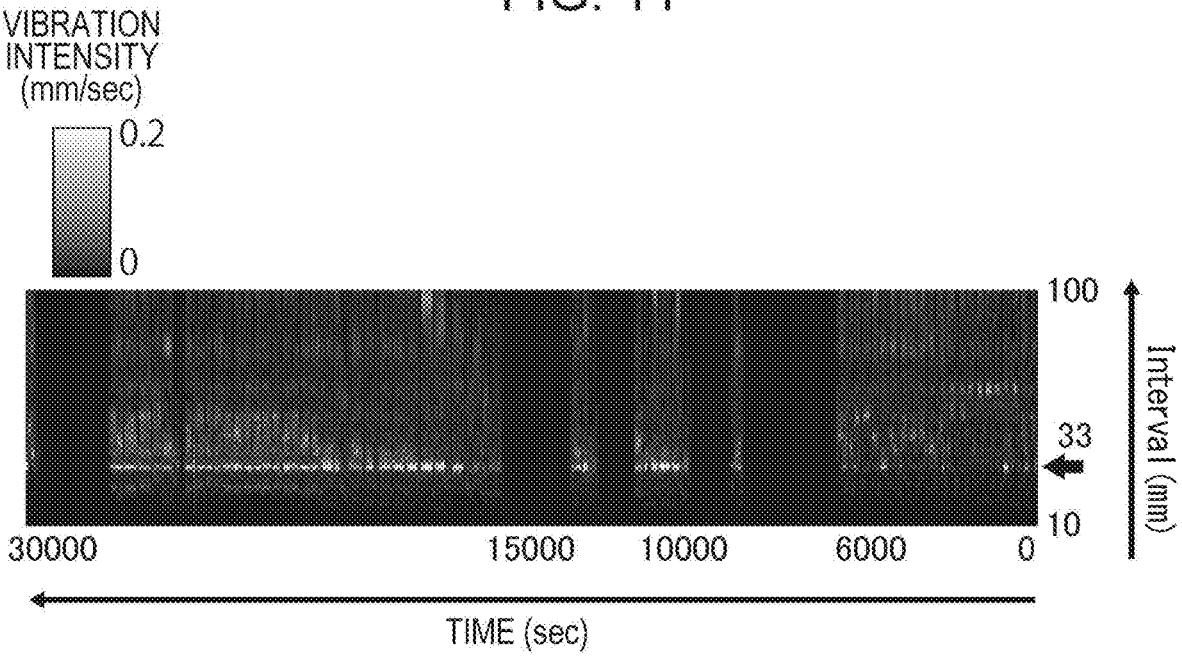
FIG. 11 illustrates an example of a vibration map for second analysis data in Example 3.

Also in Example 3, data of a vibration meter provided on an upper part of a housing on an operator side of a final stand was acquired by the data collecting unit 11, as in Example 1. In the collecting step performed by the data collecting unit 11, a data sampling period was set to 0.2 sec, and vibration data was acquired by converting accelerations acquired from the vibration meter into vibration speeds. The frequency analysis unit 12 acquired first analysis data that is vibration intensities at respective frequencies by performing Fourier transform on the time-series vibration data. In the frequency analysis step performed by the frequency analysis unit 12, a frequency was selected every 5 Hz in a frequency band of 0 Hz to 1000 Hz with respect to a sampling frequency 2000 Hz of the vibration meter, and these frequencies were used as reference frequencies. In the data conversion step performed by the data conversion unit 13, a standard rolling speed was set to 600 m/min, 201 standard intervals were set, and data (second analysis data) concerning vibration intensities at the respective intervals was acquired every data acquisition cycle. Then, in the vibration map generation step performed by the map generating unit 14, a vibration map for the second analysis data in which the vibration intensities acquired in the data conversion step were expressed as gray-scale densities was generated. FIG. 11 illustrates the vibration map thus generated. In FIG. 11, a time of replacement of backup rolls of the tandem rolling mill is set as an origin of time represented by the horizontal axis, and the vibration intensities at the respective standard intervals are arranged in time series.

In the example of the vibration map illustrated in FIG. 11, intermittent occurrence of relatively large vibration is observed in the vicinity of a standard interval of 33 mm during a period from a time (0 second) of start of measurement of vibration data to 6,000 seconds, but the vibration has not reached abnormal vibration, which is remarkable vibration. However, it can be observed that when an elapsed period from the time of the start exceeds 10,000 seconds, the vibration corresponding to the standard interval of 33 mm increases. Furthermore, it can be confirmed that when the elapsed period from the time of the start exceeds 15,000 seconds, the vibration in the vicinity of the standard interval of 33 mm appears remarkably. It was confirmed from observation of a surface of the rolled metal strip S at this time (15,000 seconds) that chatter marks were present on the surface of the metal strip S at an interval corresponding to the standard interval of 33 mm.

Figure 12:
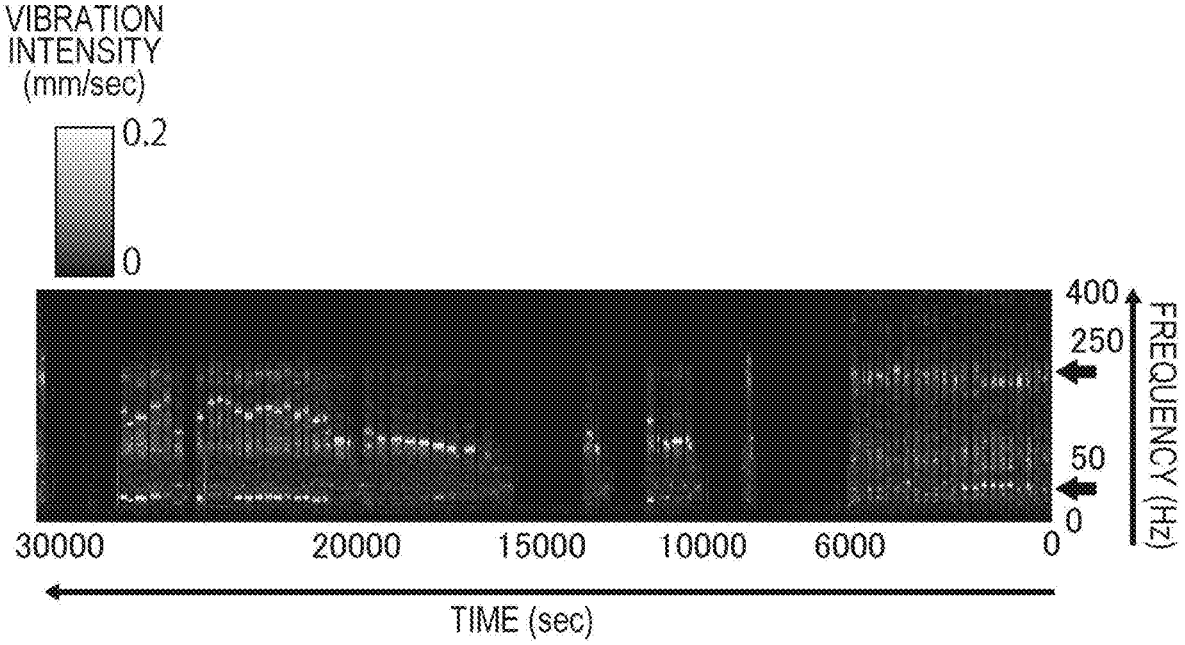
FIG. 12 illustrates an example of a vibration map for first analysis data in a comparative example.

Next, a comparative example performed to verify the abnormal vibration detection method according to Example 3 is described. In the comparative example, vibration intensities at respective frequencies were acquired by the frequency analysis unit 12 by using the same data as the vibration data acquired in Example 3. FIG. 12 illustrates an example of a vibration map for first analysis data created by arranging the vibration intensities at respective frequencies in time series. In FIG. 12, the vibration intensities at respective frequencies are indicated by color densities. In FIG. 12, a frequency band corresponding to the interval of 33 mm where chatter marks were detected in Example 3 was approximately 50 Hz or more and 100 Hz or less although the frequency band changes depending on a rolling speed. From the map of FIG. 12, a tendency is observed in which a vibration intensity is high in the vicinity of the frequencies 50 Hz and 250 Hz during a period from a time of start (0 second) to 6,000 seconds. However, when an elapsed period from the time of the start exceeds 15,000 seconds, a high vibration intensity is observed in a frequency band of 100 Hz or more and 150 Hz or less. Furthermore, when the elapsed period from the time of the start exceeds 20,000 seconds, there is a tendency in which a vibration intensity is high in the frequency band of 50 Hz or more and 100 Hz or less corresponding to the interval of 33 mm at which chatter marks were detected in Example 3, but a vibration intensity also increases in a frequency band of 150 Hz or more and 200 Hz or less. Furthermore, although there is a tendency in which a vibration intensity is high in the frequency band of 150 Hz or more and 200 Hz or less, a fluctuation in vibration intensity with passage of time is large in this frequency band, and it is therefore difficult to discriminate abnormal vibration by identifying a specific frequency band in advance.

As is clear from the above result, according to the method of identifying a frequency or a frequency band where chattering occurs in advance and detecting a vibration intensity in the frequency or frequency band, it is difficult to grasp occurrence of chatter marks resulting from minute vibration early. On the other hand, in a case where vibration intensities at respective frequencies are converted into vibration intensities at respective standard intervals on the basis of a rolling speed and a vibration map in which the vibration intensities at the respective standard intervals are arranged in time series is generated as in Examples 1 to 3, it can be visually understood that abnormal vibration gradually becomes clear even if a rolling condition varies from one metal strip S to another. It has therefore been revealed that abnormal vibration occurring in a rolling mill can be detected with certainty.

The invention claimed is:

1. A method for detecting abnormal vibration of a rolling mill that has a pair of work rolls and a plurality of backup rolls that support the work rolls, the method comprising:

collecting vibration data of the rolling mill;

generating first analysis data indicative of vibration intensities at respective frequencies by performing frequency analysis of the vibration data;

converting the first analysis data into second analysis data indicative of vibration intensities at respective intervals on a basis of a rolling speed, wherein the rolling speed is a speed of the rolling mill, and the first analysis data is converted into the second analysis data by using the rolling speed to determine the respective intervals; and generating a vibration map in which a plurality of the second analysis data are arranged in time series, wherein the vibration map is displayed on a display, and operation of the rolling mill is adjusted according to the displayed vibration map.

2. The method according to claim 1, further comprising performing principal component analysis using reference data indicative of a normal state on the second analysis data and thereby identifying outlier components at respective intervals calculated as a residual of a projection of the second analysis data onto the reference data, wherein the method further generates an outlier component map in which the outlier components at the respective intervals extracted in the principal component analysis are arranged in time series.

3. The method according to claim 2, wherein a plurality of principal components used as the reference data in the principal component analysis are set so that a cumulative value of contribution ratios of the principal components becomes equal to or larger than a reference contribution ratio when principal component analysis is performed on normal analysis data acquired during rolling performed by the rolling mill in a normal state.

4. The method according to claim 1, wherein the rolling mill is a cold rolling mill.

5. An apparatus for detecting an abnormality of a rolling mill that has a pair of work rolls and a plurality of backup rolls that support the work rolls, the apparatus comprising:

a computer configured to:

collect vibration data of the rolling mill;

generate first analysis data indicative of vibration intensities at respective frequencies by performing frequency analysis of the vibration data;

convert the first analysis data into second analysis data indicative of vibration intensities at respective intervals on a basis of a rolling speed, wherein the rolling speed is a speed of the rolling mill, and the first analysis data is converted into the second analysis data by using the rolling speed to determine the respective intervals; and generate a vibration map in which a plurality of the second analysis data are arranged in time series, wherein the vibration map is displayed on a display, and operation of the rolling mill is adjusted according to the displayed vibration man.

6. The apparatus according to claim 5, wherein the computer is further configured to perform principal component analysis using reference data indicative of a normal state on the second analysis data and thereby identifies outlier components at respective intervals calculated as a residual of a projection of the second analysis data onto the reference data, wherein the computer further generates an outlier component map in which the outlier components at the respective intervals extracted in the principal component analysis are arranged in time series.

7. A rolling method using the method according to claim 1, the rolling method comprising setting an interval to be monitored corresponding to the rolling mill in advance and replacing the backup rolls of the rolling mill in a case where a vibration intensity at the interval to be monitored in the vibration map or the outlier component map generated exceeds a preset limit vibration intensity.

8. A method for producing a metal strip, the method comprising producing a metal strip by using the rolling method according to claim 7.

9. A rolling method using the method according to claim 2, the rolling method comprising setting an interval to be monitored corresponding to the rolling mill in advance and replacing the backup rolls of the rolling mill in a case where a vibration intensity at the interval to be monitored in the vibration map or the outlier component map generated exceeds a preset limit vibration intensity.

10. A rolling method using the method according to claim 3, the rolling method comprising setting an interval to be monitored corresponding to the rolling mill in advance and replacing the backup rolls of the rolling mill in a case where a vibration intensity at the interval to be monitored in the vibration map or the outlier component map generated exceeds a preset limit vibration intensity.

11. A rolling method using the method according to claim 4, the rolling method comprising setting an interval to be monitored corresponding to the rolling mill in advance and replacing the backup rolls of the rolling mill in a case where a vibration intensity at the interval to be monitored in the vibration map or the outlier component map generated exceeds a preset limit vibration intensity.

12. A method for producing a metal strip, the method comprising producing a metal strip by using the rolling method according to claim 9.

13. A method for producing a metal strip, the method comprising producing a metal strip by using the rolling method according to claim 10.

14. A method for producing a metal strip, the method comprising producing a metal strip by using the rolling method according to claim 11.

* * * * *